US008443640B2

(12) United States Patent
Davis

(10) Patent No.: US 8,443,640 B2
(45) Date of Patent: May 21, 2013

(54) DEADBOLT LOCKING DEVICE

(75) Inventor: Elton G. Davis, Redding, CA (US)

(73) Assignee: Gregory Scott David, Lakewood, CA (US)

( * ) Notice: Subject to any disclaimer, the term of this patent is extended or adjusted under 35 U.S.C. 154(b) by 0 days.

(21) Appl. No.: 13/539,502

(22) Filed: Jul. 2, 2012

(65) Prior Publication Data

US 2013/0000369 A1 Jan. 3, 2013

Related U.S. Application Data

(60) Provisional application No. 61/571,715, filed on Jul. 1, 2011.

(51) Int. Cl.
*E05B 13/00* (2006.01)

(52) U.S. Cl.
USPC ..... 70/416; 70/211; 70/429; 292/288

(58) Field of Classification Search
USPC ..... 70/211, 416, 417, 429, 430; 292/288
See application file for complete search history.

(56) References Cited

U.S. PATENT DOCUMENTS 3,212,308 A * 10/1965 Eads ..... 70/416
3,585,827 A * 6/1971 Dominguez ..... 70/416
3,933,014 A * 1/1976 Moses ..... 70/416
4,279,137 A * 7/1981 Cook ..... 70/416
4,715,200 A * 12/1987 Katsaros ..... 70/211
4,869,086 A * 9/1989 Richards ..... 70/416
5,000,498 A * 3/1991 Upchurch ..... 292/288
5,003,803 A * 4/1991 Richards ..... 70/416
5,007,263 A * 4/1991 Taylor ..... 70/416
5,052,202 A 10/1991 Murphy
5,351,513 A * 10/1994 Ellis ..... 70/370
6,182,485 B1 2/2001 Moore
6,742,369 B1 * 6/2004 Veillette ..... 70/416
6,993,944 B2 2/2006 Hicks
7,144,052 B1 12/2006 Kent et al.
7,216,903 B1 5/2007 Kent et al.
7,284,400 B1 * 10/2007 Agozzino ..... 70/416
7,418,847 B2 9/2008 Kosi
D618,083 S 6/2010 Hansen
7,802,828 B2 * 9/2010 Hopkins et al. ..... 292/288
7,837,242 B1 11/2010 Moscarello et al.

* cited by examiner

*Primary Examiner* — Suzanne Barrett
(74) *Attorney, Agent, or Firm* — Heidi L. Eisenhut; Loza & Loza LLP

(57) ABSTRACT

Deadbolt locking devices for preventing a deadbolt from being unlocked from the outside are provided. The deadbolt locking devices may include a connecting assembly, for engaging a door knob to provide leverage to resist turning of the handle of the deadbolt, and a housing member for engaging the handle of the deadbolt when in a locked position. The deadbolt locking devices can accommodate various configurations of door hardware without sacrificing convenience of use and without sacrificing confidence in its correct placement. Various configurations of door hardware can include the position of the deadbolt knob in relation to the door knob, the angular position of the handle of the deadbolt when it is in the locked position, whether the door is hinged on the left or right side and whether the deadbolt knob turns clockwise or counter-clockwise to lock the door.

20 Claims, 8 Drawing Sheets

FIGURE 3
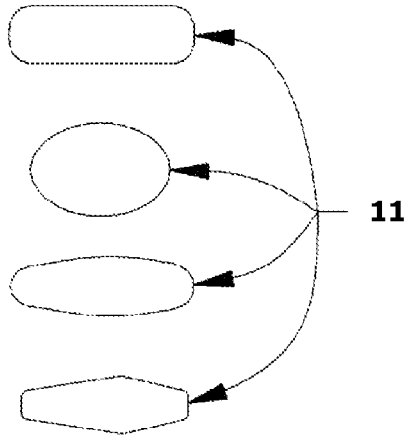
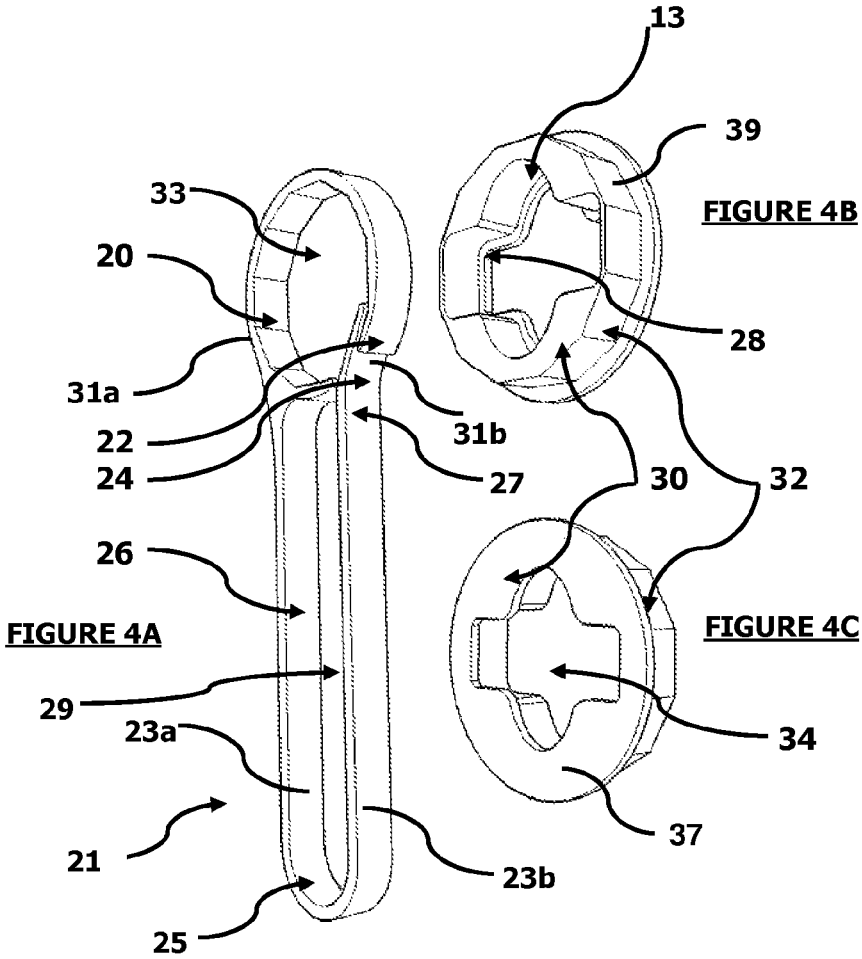
FIGURE 4A
FIGURE 4B
FIGURE 4C

FIGURE 5
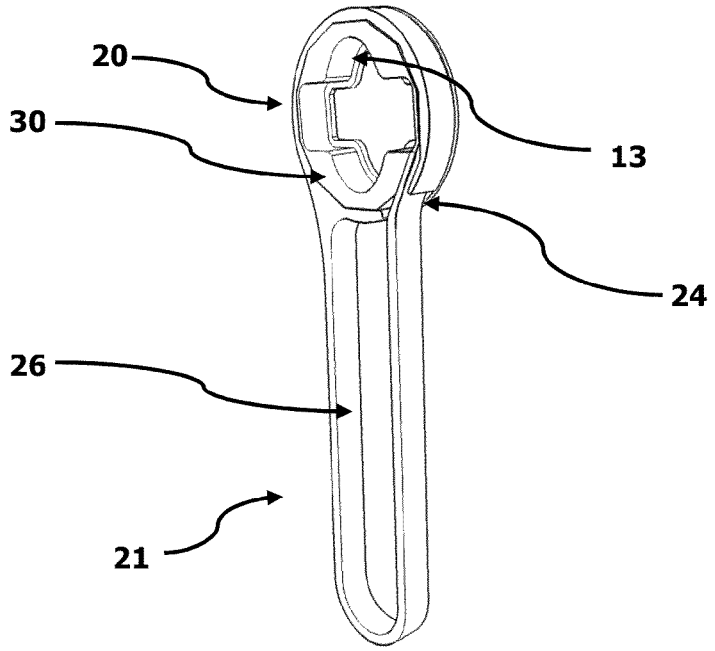
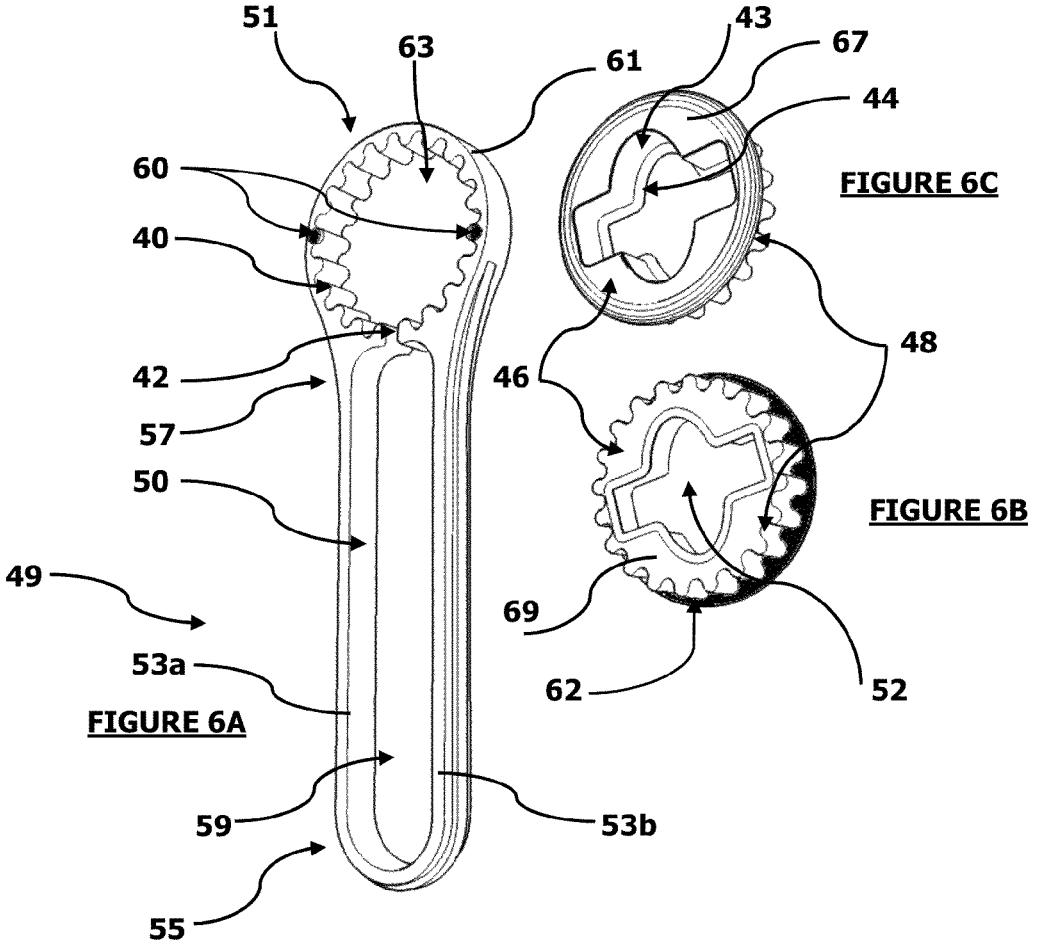
FIGURE 6A
FIGURE 6B
FIGURE 6C

DEADBOLT LOCKING DEVICE

CLAIM OF PRIORITY UNDER 35 U.S.C. §119

The present Application for Patent claims priority to U.S. Provisional Application No. 61/571,715 entitled "DEAD BOLT LOCKING DEVICE", filed Jul. 1, 2011, and hereby expressly incorporated by reference herein.

FIELD OF INVENTION

The present invention relates to deadbolt locking devices for preventing a deadbolt from being unlocked from the outside while occupants are inside.

BACKGROUND OF INVENTION

Residences, apartments and businesses continue to be broken into throughout the United States (U.S.) as well as the rest of the world. It is estimated that more than 2 million U.S. homes are victims of burglaries each year. Criminals specializing in burglary and break-ins know how to break into some 90-95% of residences through the front door. Statistics provided by the National Crime Prevention Council (NCPC) and the Department of Justice indicate nearly ⅔rds of all break-ins occur with no sign of forced entry. Unlocked doors may account for some break-ins, however, most experts agree that bump keys, lock picking, or unauthorized key use are responsible for the majority of entry methods.

Apartments are 85% more likely to be burglarized than other types of housing (2006 National Crime Prevention Council—NCPC). 44% of all apartment dwellers install deadbolts as the most common protective method. Some 60% of renters state that management companies/landlords have installed deadbolts in their apartments. Internet data indicates about 15,239,000 apartments in the U.S. NCPC data indicate 44% of apartments have deadbolts implying roughly 6 million apartment deadbolt users are subject to break-ins via bump keys, lock picking, or unauthorized keys.

Apartment and business/building managers, assistants and certain maintenance staff have access keys. Turnover of these personnel has led to an alarming number of criminal cases of key duplication resulting in subsequent break-ins.

Recognizing the millions of residences and businesses that rely on deadbolts and the alarming statistics supporting criminal access despite the use of a deadbolt, the need for a foolproof, simple, and easily used device that can be placed on the interior side of a door (in a residence, an apartment, or other building) in conjunction with the door's existing deadbolt system to defeat break-ins by preventing the deadbolt from being unlocked from the outside while the building's occupants are inside is needed.

SUMMARY

One feature provides a deadbolt locking device. The deadbolt locking device comprises a connecting assembly and a housing member. The connecting member comprises an upper portion; and a lower portion integrally connected to the upper portion by a first elongated member and a second elongated member. The housing member is inserted within the upper portion of the connecting assembly, the housing member having a handle opening adapted to receive a handle of a deadbolt. The first elongated member is parallel to the second elongated member and integrally formed together in a U-shaped configuration. The first and second wall members comprise an outer surface having a smooth surface and an inner surface segmented forming a polygonal shape.

The upper portion of the connecting member comprises a first wall member integrally connected to and extending outwardly from the first elongated member in a circular direction; and a second wall member integrally connected to and extending outwardly from the second elongated member; wherein a portion of the first wall member overlaps the second wall member defining an opening and allowing the first wall member to flex outwardly to receive housing member within the opening.

The housing member comprising a back panel having a generally circular configuration; a center section, having a generally circular configuration, integrally connected to and extending outwardly from the back panel. The center section comprises a top panel; and an outer side wall integrally connected to the top panel, the outer side wall segmented forming a polygonal shape matching the polygonal shape of the inner surface of the first and second wall members of the upper portion of the connecting assembly allowing for the mating engagement of the outer surface of the housing member and the inner surface of the first and second wall members of the upper portion of the connecting assembly.

Another feature provides a deadbolt locking device having an upper portion that comprises a wall member integrally connected to and extending outwardly from the first elongated member and the second elongated member forming a circular shape. The wall member includes a cut or slit located at a bottom portion of the wall member where the wall member extends outwardly from the first elongated member and the second elongated member, the cut allowing the first elongated member and the second elongated member to expand allowing for the insertion of the housing member. An outer surface of the wall member has a smooth surface and the inner surface of the wall member has a first plurality of teeth.

According to another feature, the housing member of the deadbolt locking device comprises a back panel having a generally circular configuration; and a center section, having a generally circular configuration, integrally connected to and extending outwardly from the back panel. The center section comprises a top panel; and an outer side wall integrally connected to the top panel, the outer side wall having a second plurality of teeth, the first plurality of teeth and the second plurality of teeth matingly engaged upon the insertion of the housing member into the wall member.

According to another feature, deadbolt locking device further comprises one or more magnets embedded within the wall member. The back panel is coated with a metallic material wherein the magnets are secured to the metallic material upon the insertion of the housing member into the wall member. Alternatively, the back panel may contain a metallic material allowing the magnets to be secured to back panel upon the insertion of the housing member into the wall member.

According to one feature, the housing member comprises a handle opening having a generally rectangular configuration having a pair of end walls integrally connected to a pair of sidewalls wherein a pair of notches are formed within the pair of sidewalls. The housing member further comprises a back panel having a generally circular configuration; and a center section, having a generally circular configuration, integrally connected to and extending outwardly from the back panel. The center section comprises a top panel; and an outer side wall integrally connected to the top panel, the outer side wall having a plurality of threads.

According to another feature, the deadbolt locking further comprises a cap having a continuous wall member having a generally circular shape defining an opening, the continuous wall having an outer smooth surface and an inner threaded surface; and wherein the cap is threadingly engaged with the plurality of threads of the outer side wall of the center section of the housing member for securing the deadbolt locking device to a deadbolt.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

FIG. 3 illustrates views of various shapes of handles that may be used with a deadbolt.

FIG. 4 (comprising FIGS. 4A-4C) illustrates a deadbolt locking device, according to one embodiment.

FIG. 5 illustrates an assembled deadbolt locking device, according to one embodiment.

FIG. 6 (comprising FIGS. 6A-6C) illustrates a deadbolt locking device, according to one embodiment.

DETAILED DESCRIPTION

In the following detailed description, numerous specific details are set forth in order to provide a thorough understanding of the embodiments. However, it will be understood by one of ordinary skill in the art that the embodiments may be practiced without these specific details and that the description is not to be taken in a limiting sense, but is made merely for the purpose of illustrating the general principles of the invention.

Embodiments of the invention are directed to deadbolt locking devices for preventing a deadbolt from being unlocked from the outside. The deadbolt locking device is non-complex hand-held apparatus that does not require the use of a key, combination lock or electronic keypad for its operation. The deadbolt locking mechanism can be easily installed and used by abled and disabled users, include users who are partially incapacitated, such as those that have restrictive use of their hands, are vision-impaired, wheel chair bound or having to use crutches.

According to one embodiment, the deadbolt locking device may require only an initial one-time alignment or assembly prior to installation. Once assembled, the deadbolt locking device cannot be mounted incorrectly such that the deadbolt is secured in the unlocked position. Additionally, the deadbolt locking device may be used on doors that are hinged on the left or right side and whether the deadbolts are locked by turning the handle on the deadbolt in a clockwise or counter-clockwise direction.

According to another embodiment, the deadbolt locking device may include an electronic system that can monitor for the attempt to unlock a deadbolt from the outside. For example, the deadbolt locking device may include a transmitter module that is in communication with a remote unit. When a deadbolt locking device is installed, the transmitter module may send a signal to the remote unit notifying the remote unit that the deadlock device has been installed. The remote unit may be in communication with a plurality of deadbolt locking devices and indicate which deadbolt locking devices have been installed and activated. For example, the remote unit may include a display, such a liquid crystal display, or a plurality of light to indicate which deadbolt locking devices have been installed and activated.

According to another embodiment, the deadbolt locking device may include a connecting assembly, for engaging a door knob to provide leverage to resist turning of the handle of the deadbolt, and a housing member for engaging the handle of the deadbolt when in a locked position.

Figure 1:
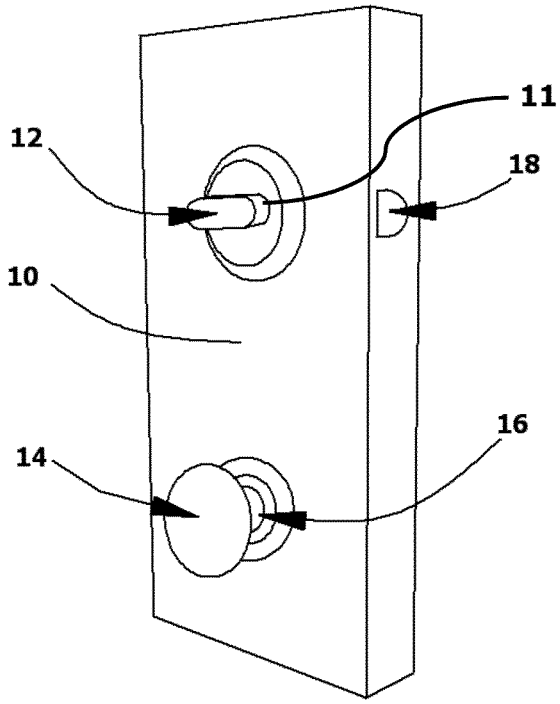
FIG. 1 illustrates a close up perspective view of a partial section of the inside of a door having a deadbolt in an unlocked position.

According to another embodiment, a deadbolt locking device is provided that can accommodate various configurations of door hardware without sacrificing convenience of use and without sacrificing confidence in its correct placement. Various configurations of door hardware can include the position of the deadbolt knob in relation to the door knob, the angular position of the handle of the deadbolt when it is in the locked position, whether the door is hinged on the left or right side and whether the deadbolt knob turns clockwise or counter-clockwise to lock the door FIG. 1 illustrates a close up perspective view of a partial section of the inside of a door having a deadbolt in an unlocked position. The door 10 may include a typical deadbolt 12 operable between an unlocked position and a locked position by use of a twist knob or handle 11. When in the unlocked position, a shaft 18 of the deadbolt 12 may be retracted into the door 10. Conversely, when in the locked position, the shaft 18 of the deadbolt 12 may be in an extended position, extending outwardly from the door 10 into a door frame or wall (not shown), for example, preventing the door 10 from being opened. According to one embodiment, rotating the handle 11 in a counter clockwise direction causes the shaft 18 to retract into the door 10 unlocking the deadbolt 12 while rotating the handle 11 in a clockwise direction causes the shaft to extend outwardly into the door frame or wall locking the deadbolt 12. Conversely, rotating the handle 11 in a clockwise direction may cause the shaft 18 to retract into the door 10 unlocking the deadbolt 12 while rotating the handle 11 in a counter clockwise direction causes the shaft to extend outwardly into the door frame or wall locking the deadbolt 12

A door handle or door knob 14 may be attached to the door 10 and used to open or close the door 10. The door knob 14 may be secured to the door 10 by a door knob shaft 16 extending outwardly in a perpendicular manner from the door 10.

Figure 2:
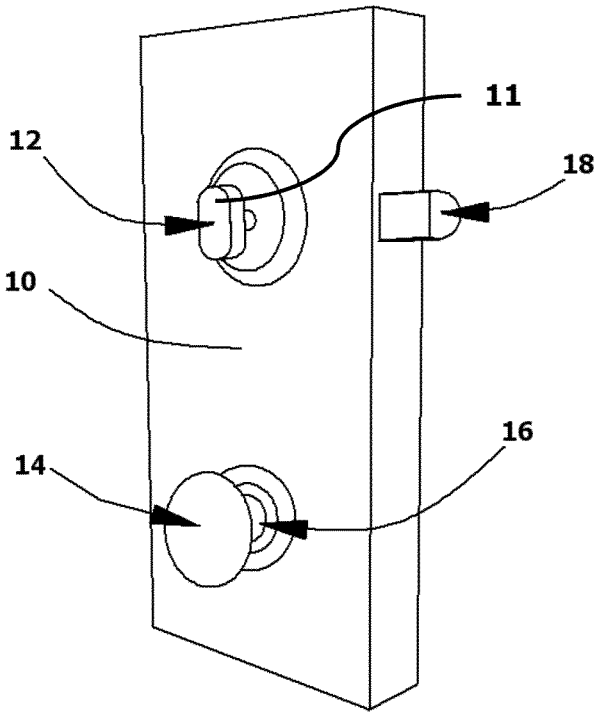
FIG. 2 illustrates a close up perspective view of the partial section of the inside of the door of FIG. 1 with the deadbolt in a locked position.

FIG. 2 illustrates a close up perspective view of the partial section of the inside of the door of FIG. 1 with the deadbolt in a locked position. As described above, when in the locked position, the shaft 18 of the deadbolt 12 may be in an extended position, extending outwardly from the door 10 into a door frame or wall (not shown), for example, preventing the door 10 from being opened.

FIG. 3 illustrates views of various shapes of handles 11 that may be used with a deadbolt. One of ordinary skill in the art will appreciate that the embodiments of the handles 11 in FIG. 3 are only examples and other shapes and sizes of handles on deadbolt may be used in connection with the deadbolt locking device of the present invention.

FIG. 4 (comprising FIGS. 4A-4C) illustrates a deadbolt locking device, according to one embodiment. As shown, the deadbolt locking device may comprise a connecting assembly 21 (FIG. 4A) and a housing member 30 (FIGS. 4B-4C), the housing member 30 to be inserted into the connecting assembly 21. The connecting assembly 21 may include a lower portion 26 integrally connected to an upper portion 20. The lower portion 26 may include first and second elongated members 23*a* and 23*b* integrally formed together at a bottom end 25 having a generally circular, elliptical or U-shaped configuration and integrally formed into the upper portion 20 at a top end 27, the upper portion 20 having a generally circular shaped configuration.

The first and second elongated members 23*a* and 23*b* may be separated by a hollow space 29 adapted to receive the door knob shaft 16 of the door knob 14. When installed, the first and second elongated members 23*a* and 23*b* may contact opposite sides of the door knob shaft 16 preventing the deadbolt locking device from turning in either direction when an attempt is made to unlock deadbolt locking device via a key from the outside. The U-shaped configuration provides contact with the fixed location door knob shaft 16 on the door 10 preventing rotation of the handle of the deadbolt locking device regardless of whether the handle is being turned clockwise or counter-clockwise.

The generally circular upper portion 20 of the connecting assembly 21 may include a first wall member 31*a* integrally connected to and extending outwardly from the first elongated member 23*a* in a circular direction and a second wall member 31*b* integrally connected to and extending outwardly from the second elongated member 23*b*. A portion 22 of the first wall member 31*a* may extend over (i.e. overlap) a portion 24 of the second wall member 31*b*. In one embodiment, the first wall member 31*a* may flex outwardly allowing the size (i.e. circumference/diameter) of an opening 33 defined by the first wall member 31*a* and the second wall member 31*b* to be adjusted allowing for the insertion of the housing member 30 into the opening 33. As shown in FIG. 4A, an outer surface of the first wall member 31*a* and the second wall member 32*a* may have a smooth surface while the inner surface of the first wall member 31*a* and the second wall member 32*a* may be segmented forming a polygonal shape, such as a twelve (12) segment polygon. The portion 24 of the second wall member 31*b* may be bent to match one of the twelve (12) segments of the housing member 30. Surface contact between the portion 24 of the second wall member 31*b* and the housing member 30 may prevent the housing member 30 from turning freely inside the connecting assembly 21 when the deadbolt's key is turned.

FIGS. 4B and 4C illustrate front and back perspective views, respectively, of the housing member 30. The opening 33 of the upper portion 20 of the connecting assembly 21 may be adapted to receive the housing member 30. The housing member 30 may have a back panel 37 and a center section 39 integrally connected to and extending outwardly from the back panel 37. An opening 34 may extend through the back panel 37 and the center section 39. A lip 28 may be formed around the opening 34 in the back surface 37. The housing member 30 may be placed around a deadbolt such that the lip 28 can be located between the rear of the handle 11 of the deadbolt 12 and the surface of the door 10 to prevent the deadbolt locking device from falling away from the handles or knobs due to vibrations.

An outer surface of the center section 39 may be segmented forming a polygonal shape, such as a twelve (12) segment polygon. The outer surface of the center section 39 may correspond to the inner surface of the upper portion 20 of the connecting assembly 21. As such, the outer surface of the center section 39 is matingly engaged with the inner surface of the upper portion 20 when the upper portion 20 of the connecting assembly 21 is placed over or around the center section 39 of the housing member 30.

The opening 34 in the upper portion 20 of the connecting assembly 21 may be shaped to fit over the handle 11 of a deadbolt 12. According to one embodiment, the opening 34 may have a generally rectangular shape with a pair of end walls and a pair of side walls. A pair of notches 13 may extend outwardly from the pair of side walls allowing for different shapes of handles of deadbolts to fit within the opening 34 in the upper portion 20 of the connecting assembly 21. For example, the pair of notches 13 allows a common shape of deadbolts known as the "egg" knob to fit within the opening.

FIG. 5 illustrates an assembled deadbolt locking device with the housing member 30 inserted into the upper portion 20 of the connecting assembly 21.

FIG. 6 (comprising FIGS. 6A-6C) illustrates a deadbolt locking device, according to one embodiment. As shown, the deadbolt locking device may comprise a connecting assembly 49 (FIG. 6A) and a housing member 46 (FIGS. 6B-6C), the housing member 46 to be inserted into the connecting assembly 49. The connecting assembly 49 may include lower portion 50 integrally connected to an upper portion 51. The lower portion 50 may include first and second elongated members 53*a* and 53*b* integrally formed together at a bottom end 55 having a generally circular, elliptical or U-shaped configuration and integrally formed into the upper portion 51 as a top end 57, the upper portion 51 having a generally circular shaped configuration.

The first and second elongated members 53*a* and 53*b* may be separated by a hollow space 59 adapted to receive the door knob shaft 16 of the door knob 14. When installed, the first and second elongated members 53*a* and 53*b* may contact opposite sides of the door knob shaft 16 preventing the deadbolt locking device from turning in either direction when an attempt is made to unlock deadbolt locking device via a key from the outside. The U-shaped configuration provides contact with the fixed location door knob shaft 16 on the door 10 preventing rotation of the handle of the deadbolt locking device regardless of whether the handle is being turned clockwise or counter-clockwise.

The generally circular upper portion 51 may include a wall member 61 integrally connected to and extending outwardly from the first elongated member 53*a* and the second elongated member 53*b* forming a circular shape. The wall member 61 may include a cut 42 for allowing first and second elongated members 53*a* and 53*b* to be spread temporarily to allow the shaft 16 of the door knob 14 to be received within the hollow space 59. When securing a deadbolt locking device to a deadbolt 12 and door knob 14, the door knob 14 may first be inserted into an opening 63 formed by the wall member 61. Once inserted into the opening 63, the cut 42 can then spread temporarily allowing the haft 16 of the door knob 14 to be received within the hollow space 59.

As shown in FIG. 6A, an outer surface of the wall member 61 may have a smooth surface while the inner surface of the wall member 61 may include a plurality of teeth 40.

According to one embodiment, one or more magnets 60 may be embedded into the upper portion 51 of the connecting assembly 49 to facilitate engagement and retention of the housing member 46 into the upper portion 51 of the connecting assembly 49.

FIGS. 6B and 6C illustrate front and back perspective views, respectively, of the housing member 46. The opening 63 of the upper portion 51 of the connecting assembly 49 may be adapted to receive the housing member 46. The housing member 46 may have a back panel 67 and a center section 69 integrally connected to extending outwardly from the back panel 67. An opening 52 may extend through the back panel 67 and extend through the central section 69. A lip 44 may be formed around the opening 52 in the back surface 67. The housing member 46 may be placed around a deadbolt such that the lip 44 can be located between the rear of the handle 11 of the deadbolt 12 and the surface of the door 10 to prevent the deadbolt locking device from falling away from the knobs due to vibrations.

An inner portion 62 of the back panel 67, surrounding the center section 69, may have a metallic material formed thereon, such as iron or steel. That is, the metallic material may be coated on a surface of the back panel 67 or may be contained within the back panel 67. When the housing member 46 is inserted or embedded into the opening 63 of the upper portion 51 of the connecting assembly 49, the magnets 60 embedded into wall member 61 of the upper portion 51 can attach themselves to the metallic material retaining the housing member 46 in the upper portion 51 of the connecting assembly 49.

An outer surface of the center 69 may include a plurality of teeth 48 corresponding to the plurality of teeth 40 on the inner surface of the wall member 61 of the upper portion 51 of the connecting assembly 49 such that the outer surface of the center section 69 is matingly engaged with the inner surface of the wall member 61 of the upper portion 51 when the upper portion 51 of the connecting assembly 49 is placed over or around the center section 69 of the housing member 46.

The opening 52 in the upper portion 51 of the connecting assembly 49 may be shaped to fit over the handle 11 of a deadbolt 12. According to one embodiment, the opening 52 may have a generally rectangular shape with a pair of end walls and a pair of side walls. A pair of notches 43 may extend outwardly from the pair of side walls allowing for different shapes of handles of deadbolts to fit within the opening 52 in the upper portion 51 of the connecting assembly 49. For example, the pair of notches 43 allows a common shape of deadbolts known as the "egg" knob to fit within the opening.

Figure 7:
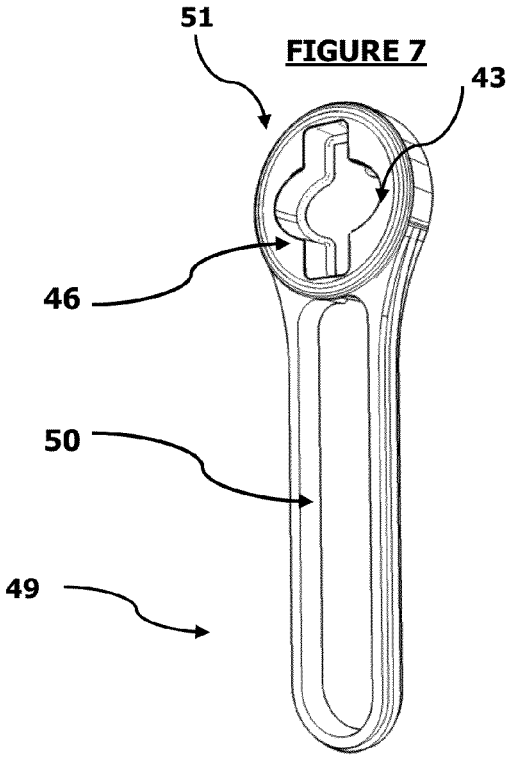
FIG. 7 illustrates an assembled deadbolt locking device, according to one embodiment.

FIG. 7 illustrates an assembled deadbolt locking device with the housing member 46 inserted into the upper portion 51 of the connecting assembly 49.

Figure 8:
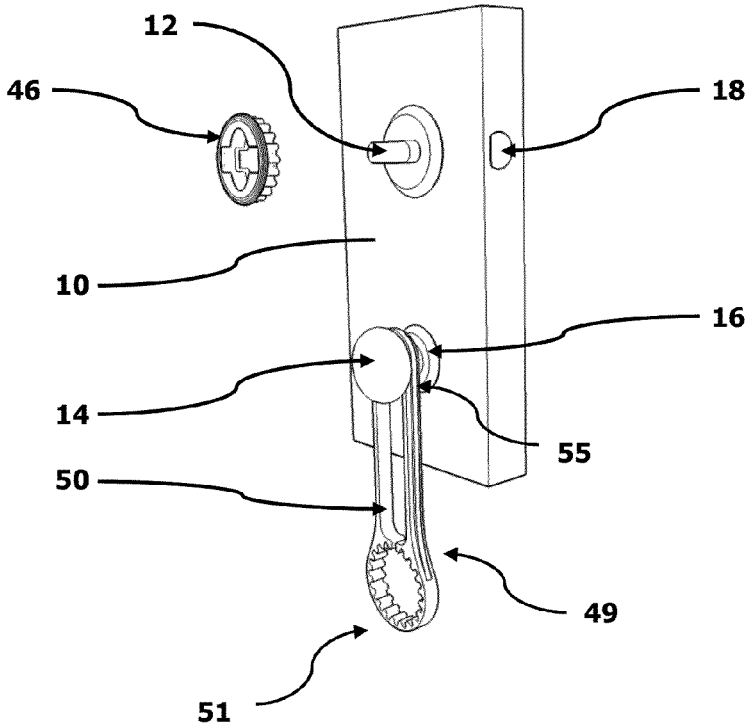
FIG. 8 illustrates the unassembled deadbolt locking device of FIG. 6 with the connecting assembly placed over a door knob.

FIG. 8 illustrates the unassembled deadbolt locking device of FIG. 6 with the connecting assembly 49 placed over a door knob 14. As shown, the bottom end 55 of the lower portion 50 of the connecting assembly 49 may be placed over the shaft 16 of the door knob 14 such that the upper portion 51 of the connecting assembly 49 is hanging below the door knob 14. The connecting assembly 49 may be rotated in a clockwise or counter clockwise direction to engage with the deadbolt 12. The housing member 46 is shown positioned in front of the deadbolt 12 prior to engagement with the deadbolt 12.

Figure 9:
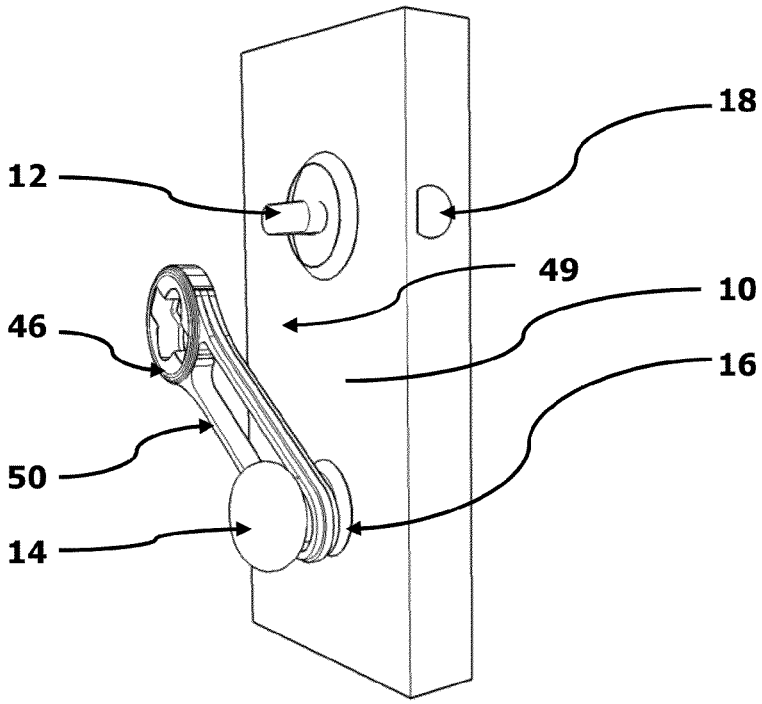
FIG. 9 illustrates the assembled deadbolt locking device of FIG. 7 with the connecting assembly placed over a door knob and rotated partially upward.

FIG. 9 illustrates the assembled deadbolt locking device of FIG. 7 having the connecting assembly 49 placed over a door knob and rotated partially upward. As shown, the deadbolt 12 is in an unlocked position and the shaft 18 of the deadbolt 12 is retracted into the door.

Figure 10:
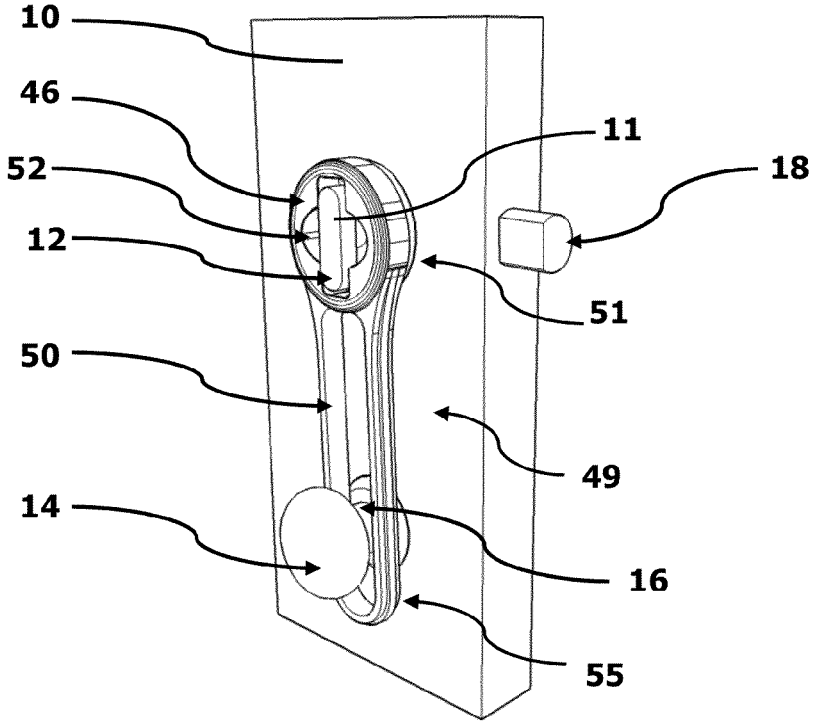
FIG. 10 illustrates the assembled deadbolt locking device of FIG. 7 secured to a door knob and deadbolt.

FIG. 10 illustrates the assembled deadbolt locking device of FIG. 7 secured to a door knob and deadbolt. As shown, the bottom end 55 of the lower portion 50 of the connecting assembly 49 is placed over the shaft 16 of the door knob 14 and the upper portion 51 of the connecting assembly 49, with the housing member 46 inserted therein, is placed over the deadbolt 12. The deadbolt 12 is in a locked position and the shaft 18 of the deadbolt 12 is an extended position. The handle 11 of the deadbolt 12 protrudes through the opening 52 in the housing member 46.

Figure 11:
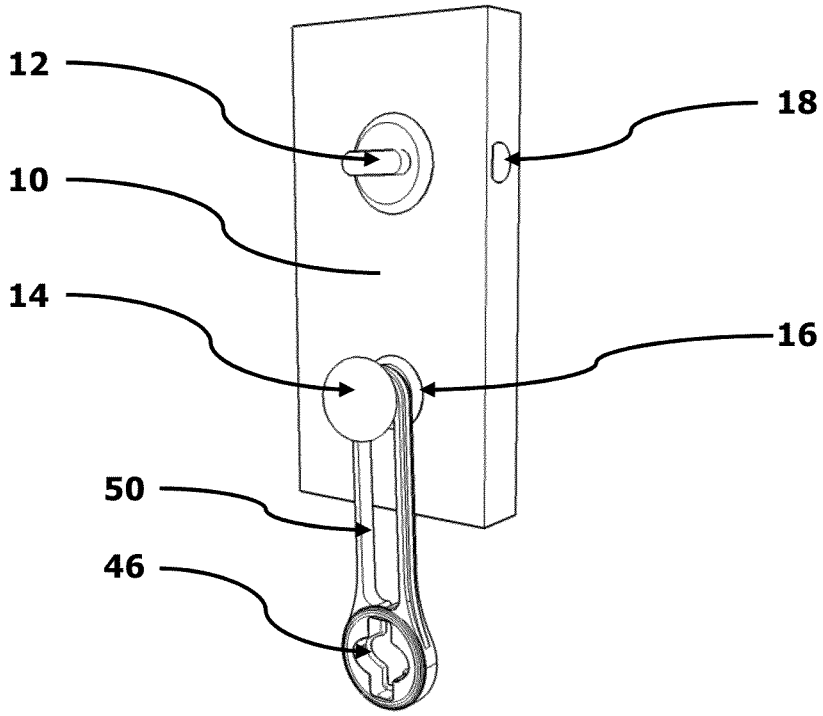
FIG. 11 illustrates an assembled deadbolt locking device hanging from a door knob in a resting position.

FIG. 11 illustrates an assembled deadbolt locking device hanging from a door knob in a resting position. That is, the deadbolt locking device has not been engaged with the deadbolt 12.

Figure 12:
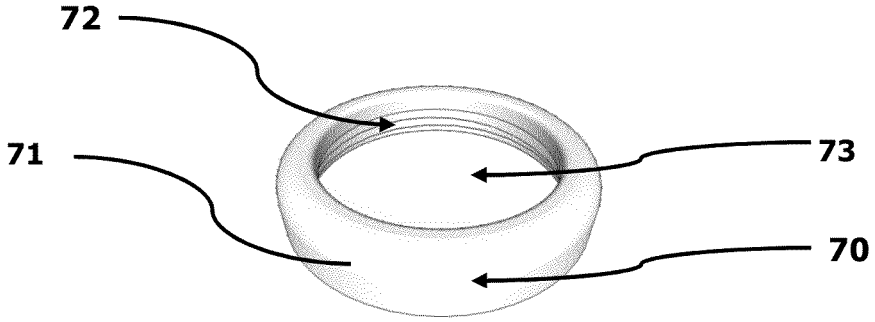
FIG. 12 illustrates a cap of a deadbolt locking device, according to one embodiment.
Figure 13:
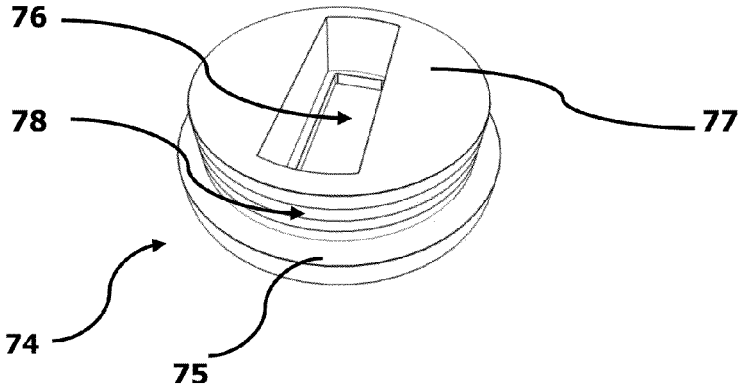
FIG. 13 illustrates a housing member of a deadbolt locking device, according to one embodiment.
Figure 14:
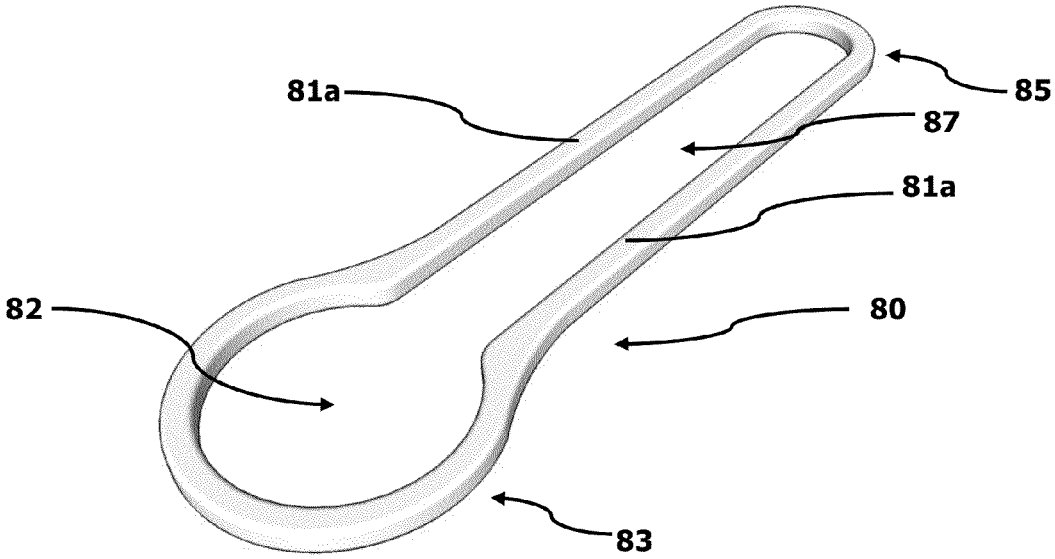
FIG. 14 illustrates a connecting assembly of a deadbolt locking device, according to one embodiment.

FIGS. 12-14 illustrate components of an unassembled deadbolt locking device, according to one embodiment. The components may include a connecting assembly 80, a housing member 74 for insertion within an upper circular opening 82 of the connecting assembly 80 and a cap 70 for threaded engagement with the housing member 74. The cap 70, as shown in FIG. 12, may comprise a continuous wall member 71, having a generally circular shape, defining an opening 73. The outer surface of the continuous wall member 71 may have a smooth surface while the inner surface of the continuous wall member 71 may have a threaded surface. The housing member 74, as shown in FIG. 13, may include a back panel 75 and a center section 77 integrally connected to and extending outwardly from the back panel 75. The upper surface of the center section 77 may be flat while the side wall of the center section 77 may be threaded 78.

According to one embodiment, the back panel 75 and the center section 77 may be circular and the diameter of the back panel 75 may be larger than the diameter of the center section 77. An opening 76 may be located within the center of the housing member 74 and extends through the back panel 75 and the center section 75. The opening 76 may be adapted to receive the handle of a deadbolt. The connecting assembly 80, as shown in FIG. 14, may comprise a top portion 83 and a bottom portion 85 integrally connected by a first elongated member 81*a* and a second elongated member 81*b*. The top portion 83 may have a generally circular shaped configuration defining a hole 82 in the center and the bottom portion 85 may have a generally U-shaped configuration. The first elongated member 81*a* and the second elongated member 81*b* may be separated by a hollow space 87 adapted to receive the door knob shaft 16 of the door knob 14. When installed, the first and second elongated members 81*a*, 81*b* may contact opposite sides of the door knob shaft 16 preventing the deadbolt locking device from turning in either direction when an attempt is made to unlock deadbolt locking device via a key from the outside. The U-shaped configuration provides contact with the fixed location door knob shaft 16 on the door 10 preventing rotation of the handle of the deadbolt locking device regardless of whether the handle is being turned clockwise or counter-clockwise.

Figure 15:
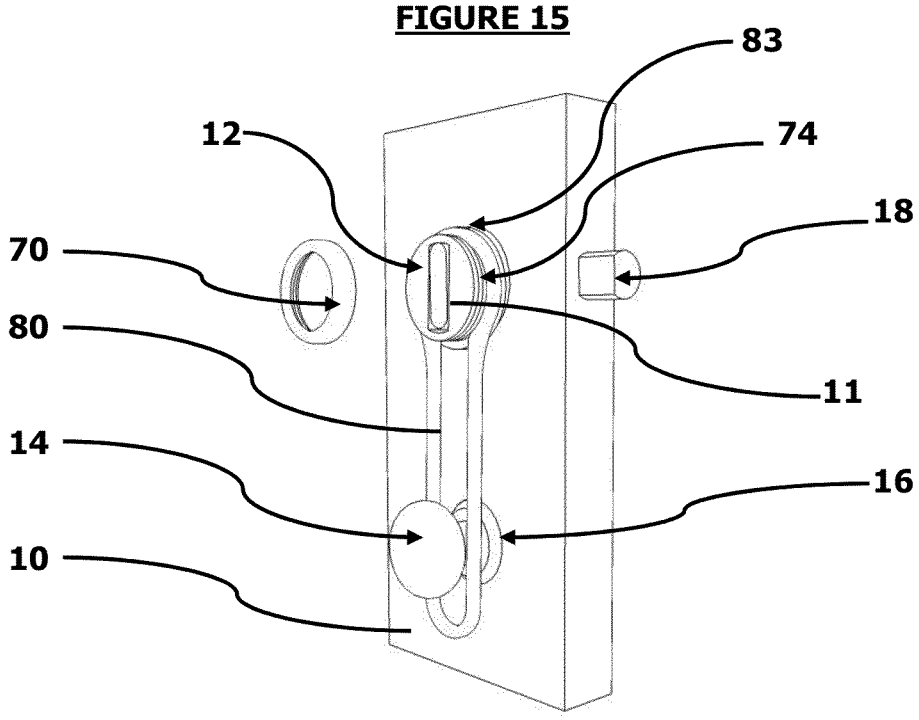
FIG. 15 illustrates a partially assembled deadbolt locking device secured to a door, according to one embodiment.
Figure 16:
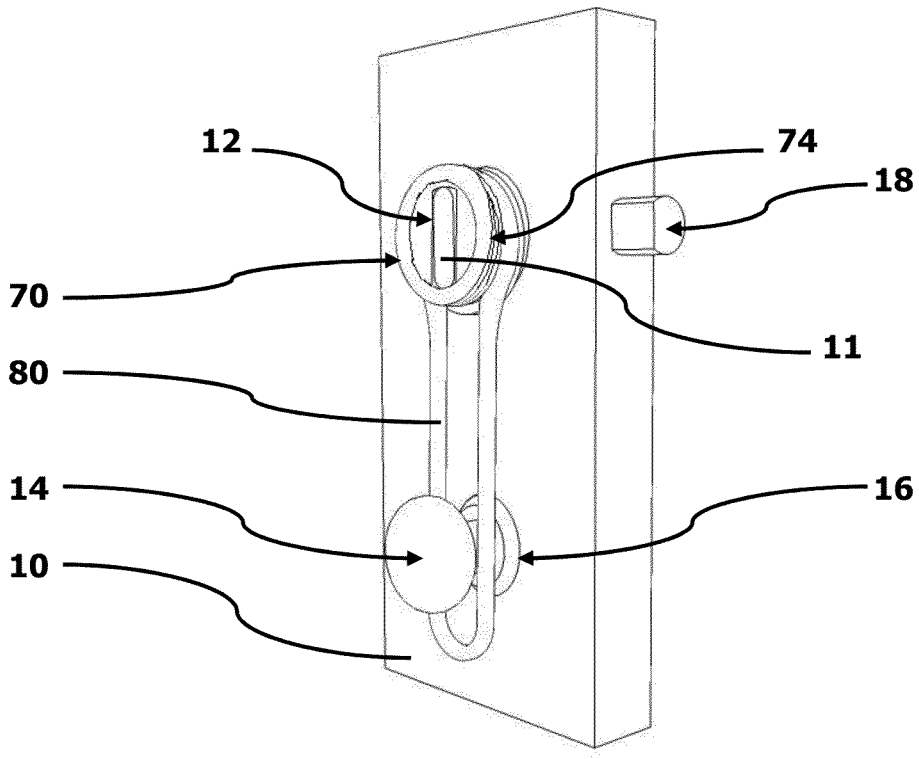
FIG. 16 illustrates the fully assembled deadbolt locking device of FIG. 15 secured to a deadbolt, according to one embodiment.

FIG. 15 illustrates a partially assembled deadbolt locking device secured to a door, according to one embodiment. As shown, the connecting assembly 80 may be mounted on the door knob 14 and deadbolt 12 located on a door 10 when the deadbolt in in a locked position and the shaft 18 is extending outward into a door jamb or wall (not shown). The housing member 74 may be mounted over the deadbolt 12 within the top portion 83 of the connecting assembly 80. The handle 11 of the deadbolt 12, located in a vertical position, may be received within the opening 76 of the housing member 74. The cap 70 may then be threadingly engaged with the housing member 74 securing the deadbolt locking device to the deadbolt preventing the deadbolt from being unlocked using a key from the outside. FIG. 16 illustrates the fully assembled deadbolt locking device of FIG. 15 secured to a deadbolt, according to one embodiment.

One or more of the components and functions illustrated in FIGS. 1-16 may be rearranged and/or combined into a single component or embodied in several components without departing from the invention. Additional elements or components may also be added without departing from the invention. Additionally, the features described herein may be implemented in software, hardware, as a business method, and/or combination thereof.

While certain exemplary embodiments have been described and shown in the accompanying drawings, it is to be understood that such embodiments are merely illustrative of and not restrictive on the broad invention, and that this invention is not to be limited to the specific constructions and arrangements shown and described, since various other modifications may occur to those ordinarily skilled in the art.

What is claimed is:

1. A deadbolt locking device comprising:

a connecting assembly, the connecting member comprising:

an upper portion; and a lower portion integrally connected to the upper portion by a first elongated member and a second elongated member; and a housing member inserted within the upper portion of the connecting assembly, the housing member having a handle opening adapted to receive a handle of a deadbolt, the housing member comprising:

a back panel having a generally circular configuration; and a center section, having a generally circular configuration, integrally connected to and extending outwardly from the back panel, the center section comprising:

a top panel; and an outer side wall integrally connected to the top panel.

2. The deadbolt locking device of claim 1, wherein the first elongated member is parallel to the second elongated member and integrally formed together in a U-shaped configuration.

3. The deadbolt locking device of claim 1, wherein the upper portion comprises:

a first wall member integrally connected to and extending outwardly from the first elongated member in a circular direction; and a second wall member integrally connected to and extending outwardly from the second elongated member;

wherein a portion of the first wall member overlaps the second wall member defining an opening and allowing the first wall member to flex outwardly to receive housing member within the opening.

4. The deadbolt locking device of claim 3, wherein the first and second elongated members are separated by a hollow space adapted to receive a shaft of a door knob preventing the deadbolt locking device from turning in a clockwise or counter clockwise direction.

5. The deadbolt locking device of claim 3, wherein the first and second wall members comprise an outer surface having a smooth surface and an inner surface segmented forming a polygonal shape.

6. The deadbolt locking device of claim 5, wherein:

the outer side wall of the center section is segmented forming a polygonal shape matching the polygonal shape of the inner surface of the first and second wall members of the upper portion of the connecting assembly allowing for the mating engagement of the outer surface of the housing member and the inner surface of the first and second wall members of the upper portion of the connecting assembly.

7. The deadbolt locking device of claim 1, wherein the upper portion comprises a wall member integrally connected to and extending outwardly from the first elongated member; and wherein the second elongated member forming a circular shape.

8. The deadbolt locking device of claim 7, wherein the wall member includes a cut located at a bottom portion of the wall member where the wall member extends outwardly from the first elongated member and the second elongated member, the cut allowing the first elongated member and the second elongated member to expand allowing for the insertion of the housing member.

9. The deadbolt locking device of claim 7, wherein an outer surface of the wall member has a smooth surface and the inner surface of the wall member has a first plurality of teeth.

10. The deadbolt locking device of claim 9, wherein:

the outer side wall of the center section has a second plurality of teeth, the first plurality of teeth and the second plurality of teeth matingly engaged upon the insertion of the housing member into the wall member.

11. The deadbolt locking device of claim 10, further comprising one or more magnets embedded within the wall member.

12. The deadbolt locking device of claim 11, wherein the back panel comprises a metallic material and wherein the magnets are secured to the metallic material upon the insertion of the housing member into the wall member.

13. The deadbolt locking device of claim 1, wherein the handle opening has a generally rectangular configuration having a pair of end walls integrally connected to a pair of sidewalls; and wherein a pair of notches are formed within the pair of sidewalls.

14. The deadbolt locking device of claim 1, further comprising a cap, the cap comprising a continuous wall member having a generally circular shape defining an opening, the continuous wall having an outer smooth surface and an inner threaded surface; and wherein the cap is threadingly engaged with the plurality of threads of the outer side wall of the center section of the housing member for securing the deadbolt locking device to a deadbolt.

15. The deadbolt locking device of claim 1, wherein a diameter of the back panel is larger than a diameter of the center section.

16. A deadbolt locking device comprising:

a connecting assembly, the connecting member comprising:

an upper portion; and a lower portion integrally connected to the upper portion by a first elongated member and a second elongated member, the first elongated member is parallel to the second elongated member and integrally formed together in a U-shaped configuration; and a housing member inserted within the upper portion of the connecting assembly, the housing member comprising:

a handle opening adapted to receive a handle of a deadbolt;

a back panel having a generally circular configuration; and a center section, having a generally circular configuration, integrally connected to and extending outwardly from the back panel, the center section comprising:

a top panel; and an outer side wall integrally connected to the top panel.

17. The deadbolt locking device of claim 16, wherein the upper portion comprises:

a first wall member integrally connected to and extending outwardly from the first elongated member in a circular direction; and a second wall member integrally connected to and extending outwardly from the second elongated member;

wherein a portion of the first wall member overlaps the second wall member defining an opening and allowing the first wall member to flex outwardly to receive housing member within the opening.

18. The deadbolt locking device of claim 17, wherein the first and second elongated members are separated by a hollow space adapted to receive a shaft of a door knob preventing the deadbolt locking device from turning in a clockwise or counter clockwise direction.

19. The deadbolt locking device of claim 17, wherein the first and second wall members comprise an outer surface having a smooth surface and an inner surface segmented forming a polygonal shape.

20. A deadbolt locking device comprising:

a connecting assembly, the connecting member comprising:

an upper portion, the upper portion comprising:

a first wall member integrally connected to and extending outwardly from the first elongated member in a circular direction; and a second wall member integrally connected to and extending outwardly from the second elongated member;

wherein a portion of the first wall member overlaps the second wall member defining an opening and allowing the first wall member to flex outwardly to receive housing member within the opening; and a lower portion integrally connected to the upper portion by a first elongated member and a second elongated member; and a housing member inserted within the upper portion of the connecting assembly, the housing member having a handle opening adapted to receive a handle of a deadbolt.

* * * * *

UNITED STATES PATENT AND TRADEMARK OFFICE

CERTIFICATE OF CORRECTION

PATENT NO. : 8,443,640 B2
APPLICATION NO. : 13/539502
DATED : May 21, 2013
INVENTOR(S) : Elton G. Davis It is certified that error appears in the above-identified patent and that said Letters Patent is hereby corrected as shown below:

On the Title Page, Item 73 under Assignee, replace "David" with --Davis--.

Signed and Sealed this
Tenth Day of September, 2013

Teresa Stanek Rea
*Acting Director of the United States Patent and Trademark Office*